US009115511B1

(12) United States Patent
Schmidt et al.

(10) Patent No.: US 9,115,511 B1
(45) Date of Patent: Aug. 25, 2015

(54) PADLOCK WITH ALARM AND SHACKLE LOCKING MECHANISM

(71) Applicants: Donald M. Schmidt, Fort Myers, FL (US); Ronald J. Sargent, Fort Lauderdale, FL (US)

(72) Inventors: Donald M. Schmidt, Fort Myers, FL (US); Ronald J. Sargent, Fort Lauderdale, FL (US)

(73) Assignee: Donald M. Schmidt, Fort Myers, FL (US)

( * ) Notice: Subject to any disclaimer, the term of this patent is extended or adjusted under 35 U.S.C. 154(b) by 97 days.

(21) Appl. No.: 13/959,916

(22) Filed: Aug. 6, 2013

Related U.S. Application Data

(60) Provisional application No. 61/680,792, filed on Aug. 8, 2012.

(51) Int. Cl.

| | |
|---|---|
| ***E05B 45/00*** | (2006.01) |
| ***E05B 67/18*** | (2006.01) |
| ***E05B 45/06*** | (2006.01) |
| ***E05B 67/00*** | (2006.01) |
| ***E05B 67/08*** | (2006.01) |

(52) U.S. Cl.
CPC ..... *E05B 45/005* (2013.01); *E05B 45/00* (2013.01); *E05B 45/06* (2013.01); *E05B 67/00* (2013.01); *E05B 67/08* (2013.01); *E05B 67/18* (2013.01)

(58) Field of Classification Search
CPC ..... E05B 67/00; E05B 67/08; E05B 67/18; E05B 67/20; E05B 67/22; E05B 67/24; E05B 45/00; E05B 45/005; E05B 45/06
See application file for complete search history.

(56) References Cited

U.S. PATENT DOCUMENTS

| | | | | |
|---|---|---|---|---|
| 3,653,235 | A * | 4/1972 | Fane et al. | 70/38 A |
| 3,710,603 | A * | 1/1973 | Miller | 70/38 A |
| 3,754,419 | A * | 8/1973 | Taylor | 70/52 |
| 3,781,861 | A * | 12/1973 | Adler et al. | 340/571 |
| 3,789,639 | A * | 2/1974 | Canter | 70/437 |
| 5,174,136 | A * | 12/1992 | Thwing | 70/38 A |
| 5,727,405 | A * | 3/1998 | Cromwell | 70/38 B |
| 2007/0234766 | A1 * | 10/2007 | Rohde et al. | 70/52 |
| 2012/0209357 | A1 * | 8/2012 | Ha | 607/90 |

* cited by examiner

*Primary Examiner* — Andrew Bee
(74) *Attorney, Agent, or Firm* — William E. Noonan

(57) ABSTRACT

A padlock alarm system includes a shackle that carries a cut sensing element and a switch actuator that operates an alarm switch to activate an alarm when the shackle is cut. A shackle retention assembly is operated by a key cylinder to selectively open and close the lock.

20 Claims, 9 Drawing Sheets

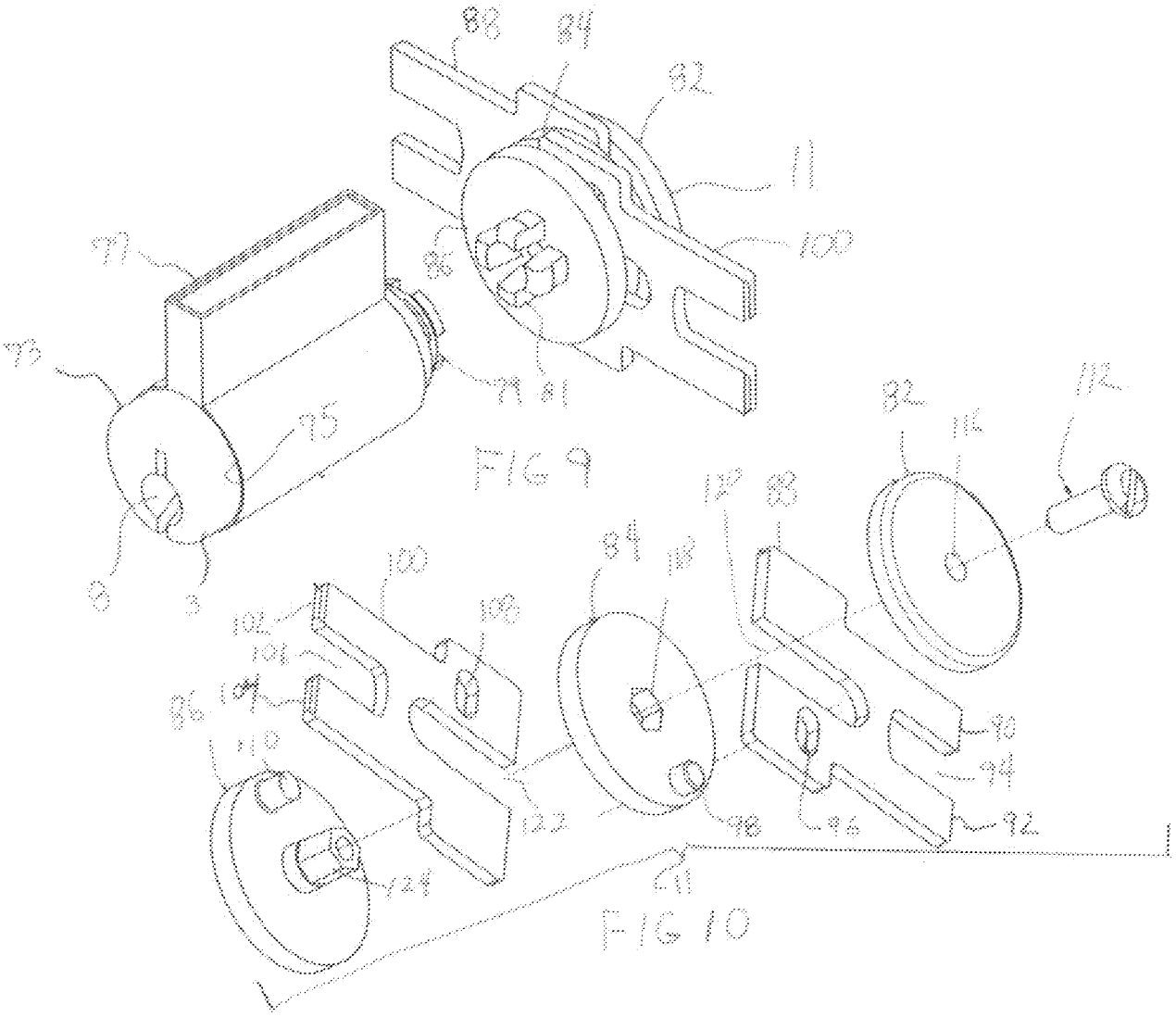
112
114
82
90
94
92
96
98
102
104
106
108
110
116
118
120
122
124
126
128
130
132
134
136
138
140
142
144
146
148
150
152
154
156
158
160
162
164
166
168
170
172
174
176
178
180
182
184
186
188
190
192
194

PADLOCK WITH ALARM AND SHACKLE LOCKING MECHANISM

RELATED APPLICATION

This application claims the benefit of U.S. Provisional Patent Application Ser. No. 61/680,792 filed Aug. 8, 2012.

FIELD OF THE INVENTION

This invention relates to a theft resistant padlock featuring an audible alarm for indicating that the lockable shackle or hasp of the padlock has been cut. The padlock also prevents the shackle from being rotated and opened if it is cut.

BACKGROUND OF THE INVENTION

Padlocks have long been used to secure lockers, lockboxes and various other enclosures. Conventional padlocks have been quite susceptible to being cut and removed by a thief. This can result in locked valuables being stolen.

Various audible alarms have been developed for sounding an alert when the bent locking arm of the padlock is cut. These known alarms exhibit a number of shortcomings. For one thing, they invariably feature fairly complicated wiring that is run through the lock arm of the padlock. Such items are expensive and typically impractical to manufacture and market. In addition, conventional padlock alarms often do not successfully deter a thief because as soon as one side of the bent arm is cut and the alarm sounds, the arm may be pivoted open by the thief and the padlock removed. This allows the thief to quickly remove locked valuables from the enclosure and depart the scene before the alarm has sounded long enough to effectively alert others of the theft. The same problem is exhibited with conventional padlocks lacking an alarm. As soon as the bent arm is cut, the arm may be quickly pivoted open and removed. Simply adding an audible alarm to the padlock has reduced but certainly not eliminated this problem.

SUMMARY OF THE INVENTION

It is therefore an object of the present invention to provide for an improved padlock alarm that produces a loud and effective continuous audible alert as soon as the arm or shackle of the padlock is cut so that disabling of the padlock and theft of locked valuables is more effectively deterred.

It is a further object of this invention to provide an improved padlock featuring both an effective audible alarm that indicates that the lock has been cut and a unique shackle locking system that prevents the locking shackle from being pivoted open and the padlock removed when only a single cut is formed in the shackle.

It is a further object of this invention to provide a padlock featuring a theft-deterring alarm that is conveniently and automatically disabled when the shackle of the lock is properly opened using a matching key.

It is a further object of this invention to provide a padlock alarm featuring a much simpler and more efficient and reliable construction than conventional padlock alarms.

It is a further object of this invention to provide a padlock containing an integral alarm that presents a significantly improved deterrence to potential thieves.

This invention results from a realization that an improved and more efficient padlock alarm may be achieved by employing a spring loaded alarm switch actuator that senses when the shackle of the lock is cut and operates a theft deterring alarm in response to such cutting. In addition, this invention results from a realization that a locking retainer may be incorporated into the lock body both for preventing the arm from being pivoted open when a single cut is made in the arm and for providing that the alarm circuit is activated and an audible alarm sound is made only when the shackle of the padlock is locked and armed. This conserves battery life and prevents the alarm from sounding when the padlock is properly opened in a keyed manner by its owner.

This invention features a padlock that incorporates an audible alarm and shackle locking system. The padlock includes a lock body and an elongate locking shackle having a first end portion that is received retractably and pivotably within an interior chamber of the lock body. An opposite second end portion of the shackle is alignable with and selectively received by a receptacle in the lock body to close the lock. The lock body further accommodates a keyhole cylinder that is axially rotatable therein. The keyhole cylinder includes a keyhole for receiving a matching key that may be engaged with the keyhole and turned to axially rotate the keyhole cylinder within the lock body. A shackle retention assembly is operably connected to the keyhole cylinder. The shackle retention assembly includes an opposing pair of retention members that are lockingly engageable with corresponding locking slots formed proximate respective opposite ends of the shackle. More particularly, a first one of the retention members is engageable with a first locking slot formed in the first end portion of the shackle, which is pivotally received within the lock body chamber. The second retention member is alignable and engageable with a second locking slot formed in the second end portion of the locking shackle when that end is received within the receptacle of the lock body. When the first end portion of the shackle is retracted into the lock body chamber and the second end is received by the receptacle, the keyhole cylinder may be axially turned in a first direction by an engaged matching key such that the retention members are engaged with the respective locking slots to hold the shackle in a closed and locked condition. An alarm circuit is also mounted within the lock body. The alarm circuit includes an audible alarm, a battery power source and a switch interconnecting the battery and the alarm. The switch alternately activates and deactivates the alarm. The shackle carries a cut detection sensor for sensing when the shackle has been cut. A switch actuator is responsive to the sensor for operating the switch to activate and sound the alarm when the shackle is cut.

In a preferred embodiment, the lock body includes a battery compartment proximate the receptacle in the lock body. The receptacle may further accommodate a removable plug that covers and retains the battery within the compartment. The plug may include a retention member engagement slot that is alignable with the locking slot proximate the second end of the shackle for receiving a respective retention member to hold the shackle in the locked condition. When the shackle is opened, the plug may be removed from the receptacle to permit removal and replacement of the battery.

Each retention member preferably includes a forked plate. Each plate may include a pair of spaced apart and generally parallel fingers, each finger being receivable in a corresponding locking slot in the shackle. Each locking slot may be formed by a pair of diametrically opposed, flat bottom notches in the shackle.

A matching key may be engaged with the keyhole cylinder and turned in the first direction to extend the retention plates whereby the plates engage the corresponding locking slots. Turning the matching key in an opposite second direction retracts the retention plates whereby the plates disengage the corresponding locking slots.

The cut detection sensor may include an elongate cable or other element that extends through an interior central channel or bore of the shackle. One end of the cable may be secured proximate the second end of the shackle. The opposite end of the sensor element may be secured to the switch actuator. The switch actuator may include a sleeve that is longitudinally slidable within the channel of the shackle and extends beyond the first end thereof. The switch may be disposed in the lock chamber and the switch actuator may extend from the first end portion of the shackle into the lock chamber. A first shackle lifting spring in the lock chamber spring may urge the shackle upwardly within the lock body so that the switch actuator disengages the alarm switch and the alarm remains deactivated. When the shackle is in a locked condition and a matching key is engaged with the keyhole and operated to axially turn the keyhole cylinder in an opposite reverse direction, the retention members are caused to disengage the corresponding locking slots and the first spring opens the shackle relative to the lock body.

A second spring switch actuator may interconnect the first end portion of the shackle for urging the switch actuator sleeve to slide outwardly from the shackle channel. If the shackle and enclosed cut detention sensor are transversely cut when the shackle is closed and locked, the sensor releases the switch actuator and the second spring urges the switch actuator to engage the switch and activate the alarm.

The first shackle lifting spring may be interconnected between the shackle and a body of the switch. When the retention members are disengaged from the locking slots, the shackle may be further retracted against the shackle lifting spring until the switch actuator engages and closes the alarm switch. This activates the alarm for emergency and test purposes.

Preferably, the retention plate assembly includes a pair of retention plates that are operably interconnected by a linkage assembly to the key cylinder. The linkage assembly may include at least two rotatable actuator disks that are parallel to one another. At least some of the disks may include respective cam elements or detents that engage corresponding cam slots formed in the retention plates. Axially rotating the keyhole cylinder in the forward direction turns the cam disks, which drives the retention plates to extend and engage the corresponding locking slots in the shackle. Axially rotating the keyhole cylinder in an opposite, reverse direction turns the cam disks to drive the retention plates such that they retract and disengage the corresponding locking slots in the shackle. The retention plates and engaged cam disks are preferably accommodated entirely within the lock body. The keyhole cylinder may be axially rotatably mounted within a cylindrical cartridge that carries an anti-rotation block or rib for mounting in a conforming pocket in the lock body to restrict rotation of the cartridge therein.

DETAILED DESCRIPTION OF PREFERRED EMBODIMENTS

Other objects, features and advantages will occur from the following description of a preferred embodiment and the accompanying drawings, in which:

FIG. 9 is a perspective view of the keyhole cylinder cartridge and the retention assembly oriented generally in the manner in which they are operatively engaged in the lock body, but separated for clarity and illustration;

FIG. 10 is an exploded view of the shackle retention assembly;

Figure 1:
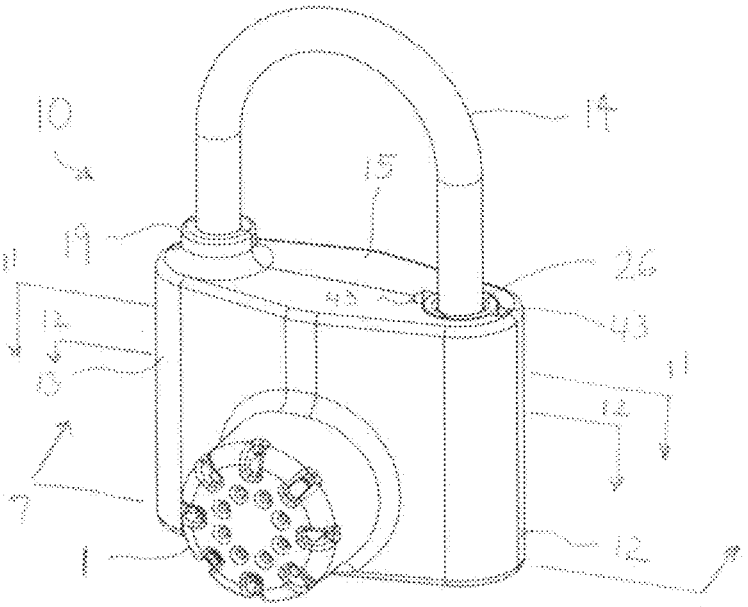
FIG. 1 is a front perspective view of a preferred embodiment of a padlock incorporating the theft resistant features of this invention.
Figure 2:
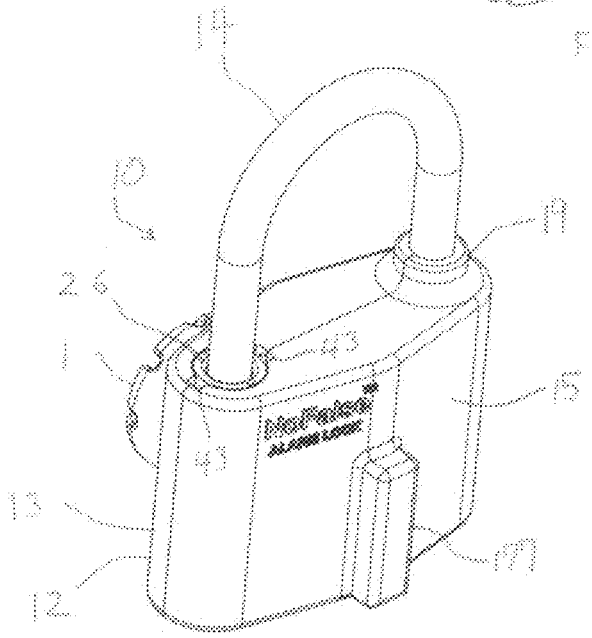
FIG. 2 is an alternative, rear perspective view of the padlock.
Figure 3:
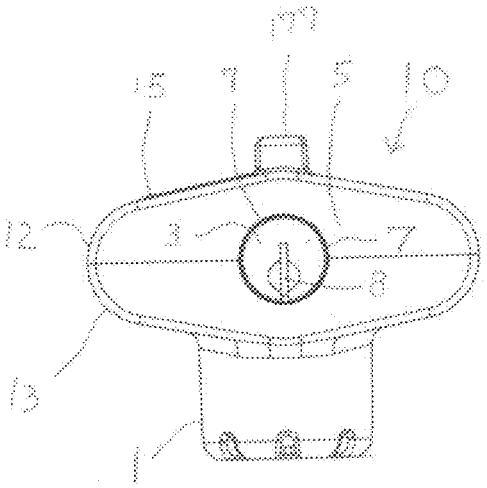
FIG. 3 is a bottom view of the padlock illustrating the keyhole cylinder.

There is shown in FIGS. 1-3 a padlock 10 having an anti-theft alarm and a shackle locking system in accordance with this invention. Padlock 10 includes a lock body 12 that is preferably composed of a molded plastic. Metals may also be employed although plastics allow the locked body to be molded so that appropriate receptacles and compartments may be formed in the locked body for accommodating various components of the lock as described below. Body 12 includes front and back half pieces 13 and 15 respectively which may be joined unitarily or alternatively molded separately and secured together by adhesives, snap fasteners or other conventional means.

Front piece 13 of lock body 12 carries an alarm housing 1 that protrudes outwardly from the lock body. The alarm housing 1 accommodates an audible alarm of padlock 10, which alarm is described more fully below. Openings are formed in housing 1 for emitting audible alarm signals from the padlock as required.

An axially rotatable keyhole cylinder 3, FIG. 3, is operably mounted within the lock body and is exposed through an opening in bottom surface 5 thereof. More particularly, the cylinder is incorporated in a cartridge 7, described more fully below, which is secured within lock body 12. Keyhole cylinder 3 includes a keyhole 8 that accepts a matching key and is operated in a manner that will be described more fully below in order to selectively lock or unlock padlock 10.

Figure 4:
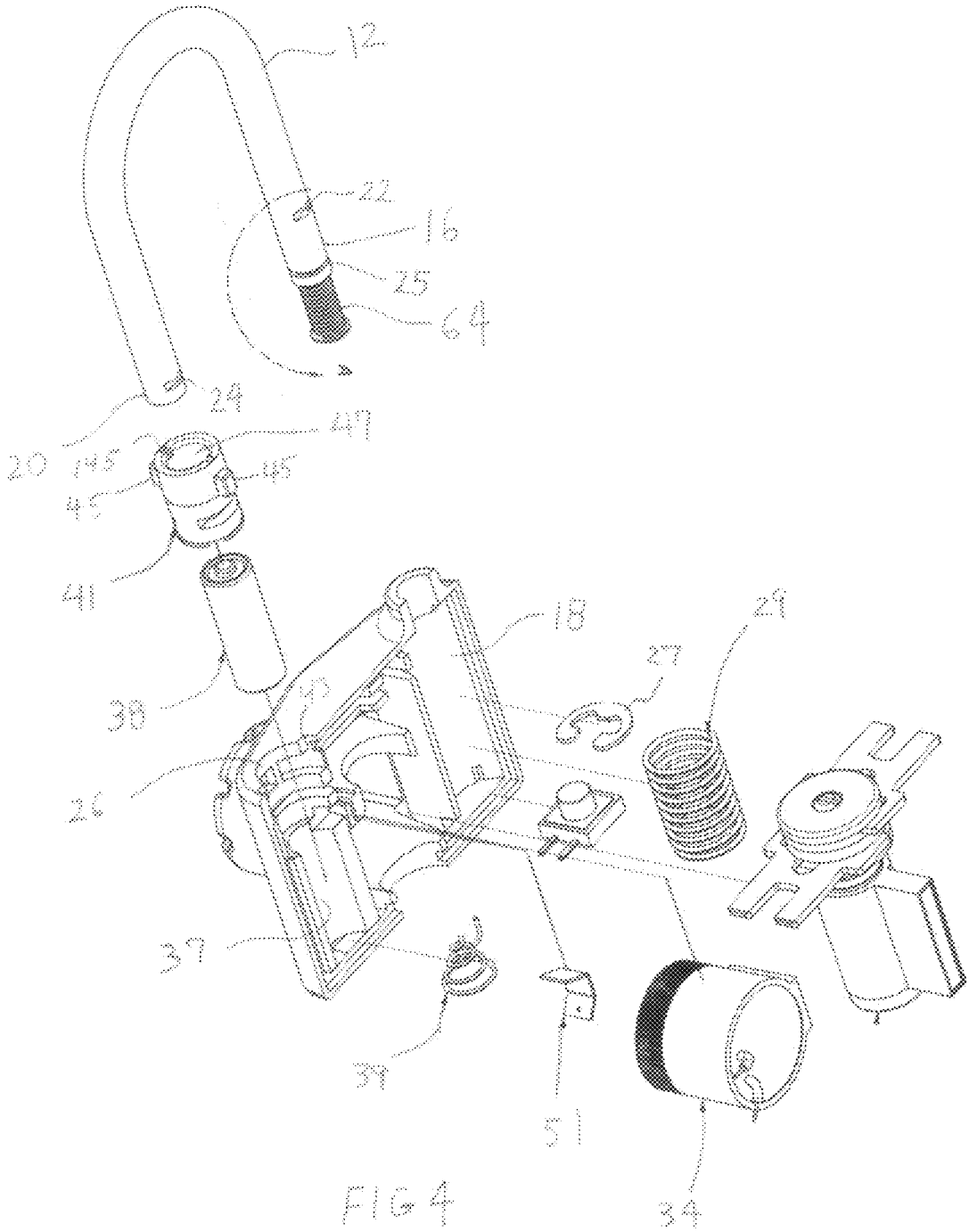
FIG. 4 is an exploded view of the padlock including the front half of the lock body, the shackle and the internal components of the lock.
Figure 5:
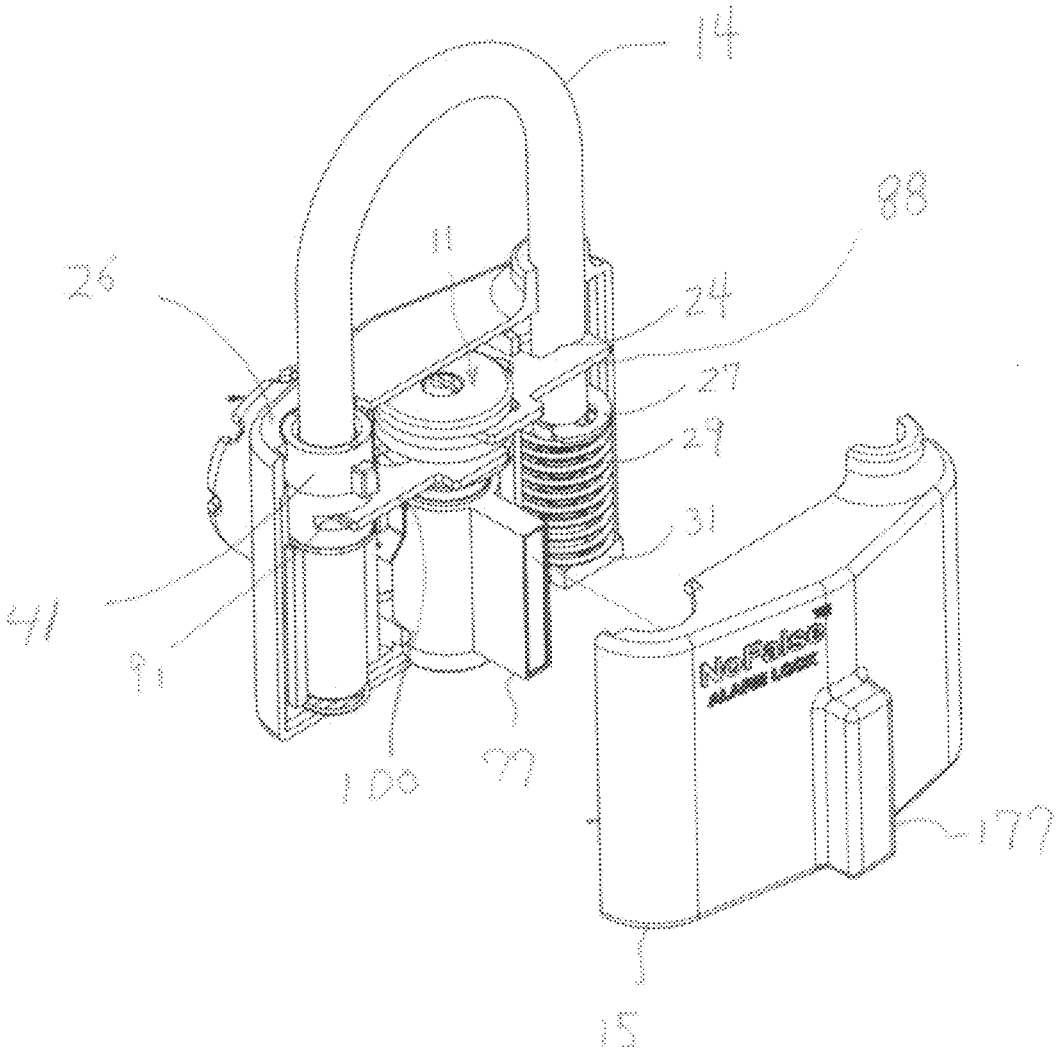
FIG. 5 is a partially exploded, rear perspective view of the padlock of FIGS. 1-4, which depicts the components of the padlock as installed and assembled in the front half of the padlock body.
Figure 5A:
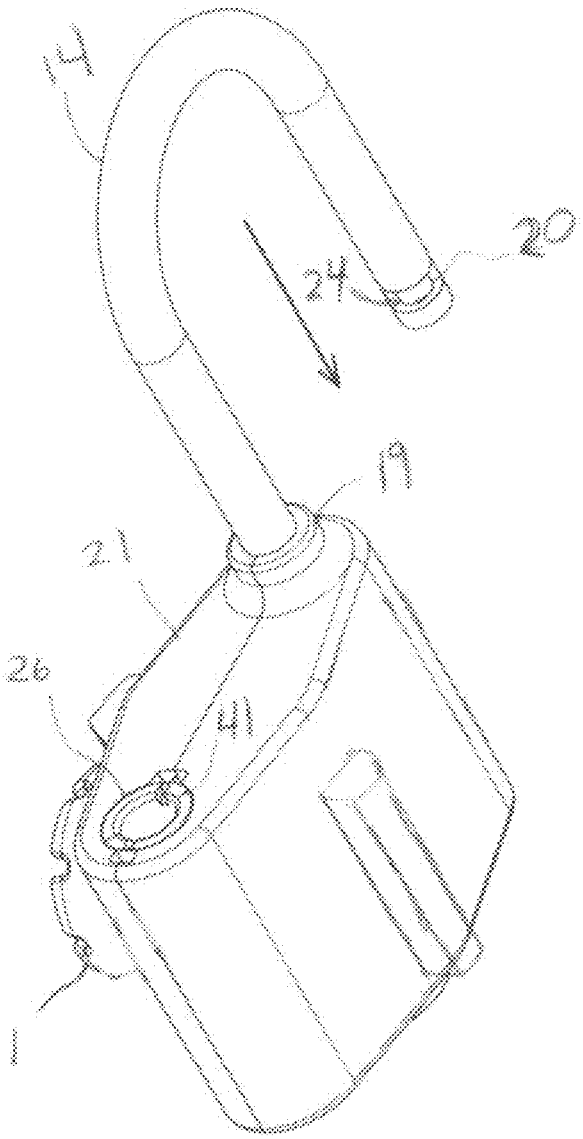
FIG. 5A is a rear perspective view of the padlock with the shackle in an open condition.

A hasp or shackle 14, FIGS. 1 and 2, includes a first or proximal end portion 16, FIG. 4, which is captured in an interior chamber 18 of lock body 12. The shackle extends upwardly through a bushing 19 in lock body 12 and curves in a conventional U-shaped fashion to terminate at a second, distal end portion 20 (see FIGS. 4 and 7). The shackle may include a plastic coating covering at least the portion of the shackle that is exposed from the lock body when the shackle is closed and retained at both ends (as described below) and thereby locked within the lock body. The second, distal end of the shackle is shown engaged with a receptacle 26 and thereby locked into the lock body in FIGS. 1, 2, 3, 6 and 7. Alternatively, the distal end of the shackle is shown opened and disengaged from the lock body and in an unlocked condition in FIG. 5A. A pair of locking notches or slots 22 (FIGS. 4-6) and 24 (FIGS. 4, and 5A) are formed in shackle 14 adjacent to proximal and distal end portions 16 and 20 respectively. Proximal end portion 16 of shackle 14 includes a circumferential groove 25, best shown in FIGS. 4 and 7 that accommodates a snap ring 27. The snap ring is engaged by the upper end of a helical outer spring or shackle lifting spring 29. The lower end of spring 29 engages the base 31 of an alarm switch 32. The alarm switch body, in turn, is mounted interiorly on the bottom 5 of lock body 12. Accordingly, spring 29 supports snap ring 27 and proximal end 16 of shackle 14 retractably within chamber 18. Spring 29 urges shackle 14 upwardly relative to the lock body. At the same time, snap ring 27 limits upward movement of shackle 14, captures end 16 of shackle 14 within chamber 18 and prevents the shackle from being fully detached from the lock body even when the lock is opened, as shown in FIG. 5A. In the open condition, shackle 14 may be pivoted rotatably about proximal end 16. The shackle may be pivoted to a position wherein distal second end 20 is aligned with receptacle 26 formed in lock body 12. With end 20 so aligned, shackle 14 may be pushed downwardly and retracted against spring 29 to insert end 20 of shackle 14 into receptacle 26. This enables the shackle to be locked in a manner depicted in FIGS. 1-3, 5 and 6. The locking operation and means for retaining and locking the shackle in the lock body are described more fully below.

Figure 6:
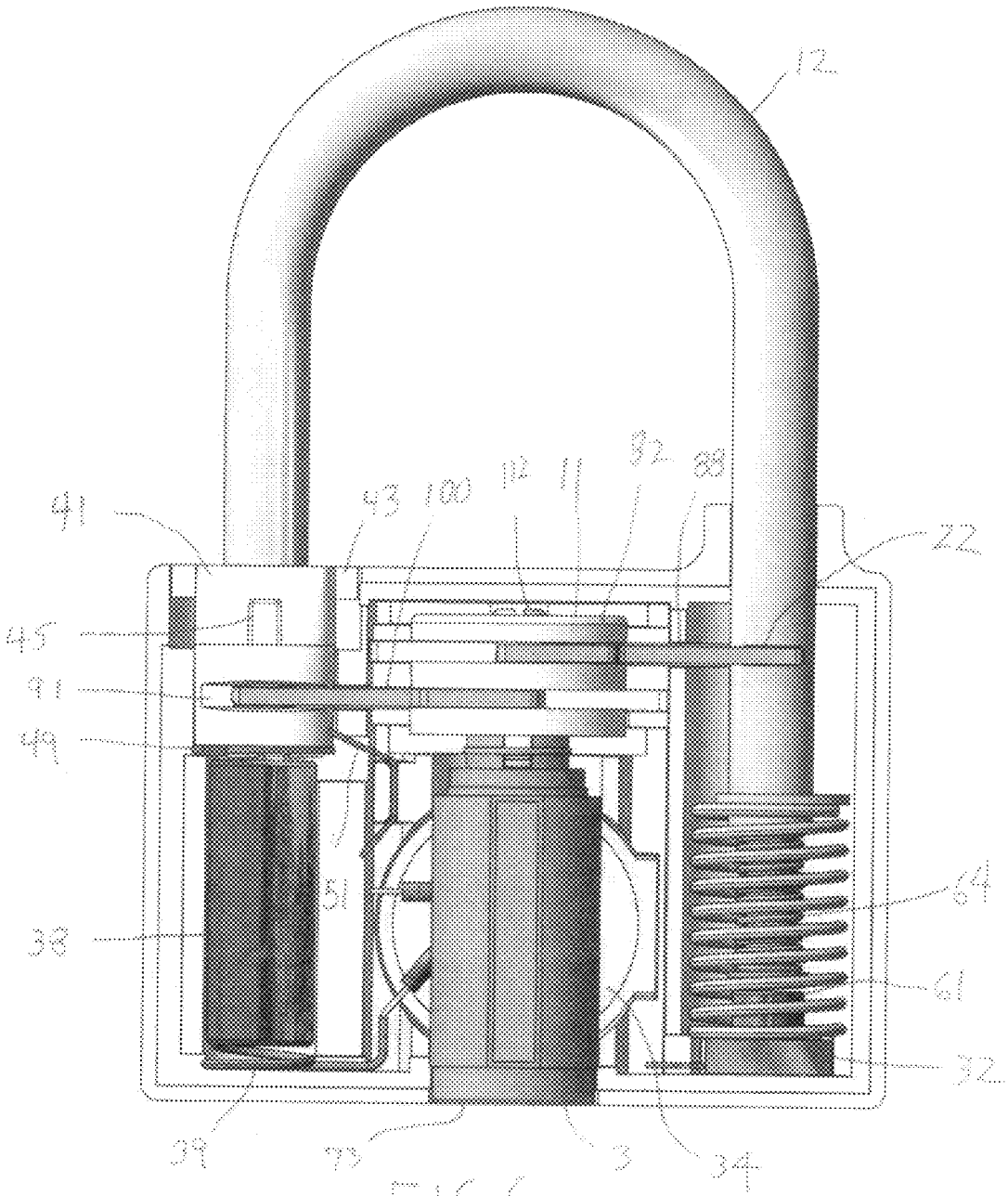
FIG. 6 is an elevational rear view of the padlock with the rear half of the padlock body removed to depict the components of the padlock within the front half of the device.
Figure 7:
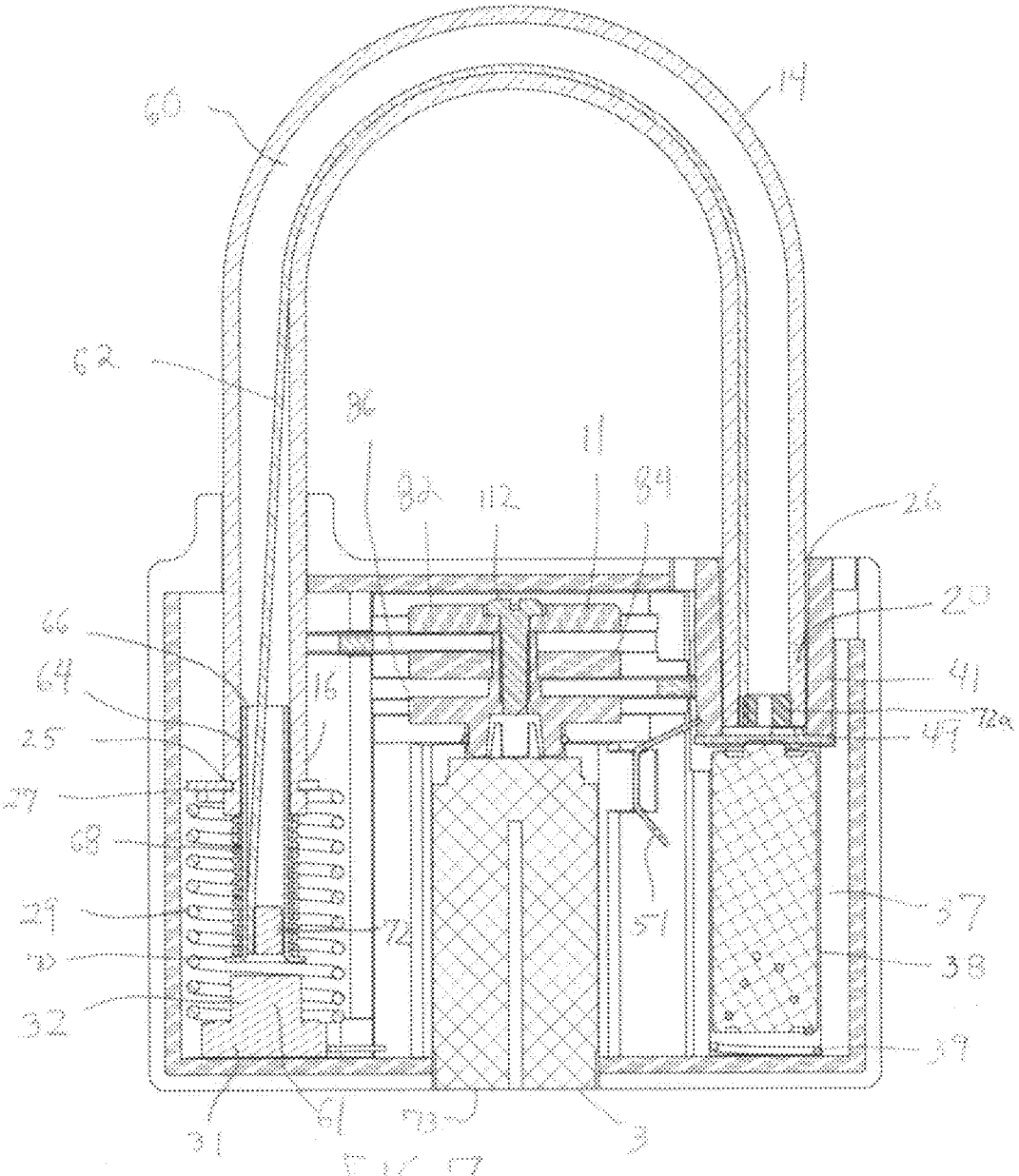
FIG. 7 is an elevational, cross sectional view of the padlock taken along line 7-7 of FIG. 1.
Figure 8:
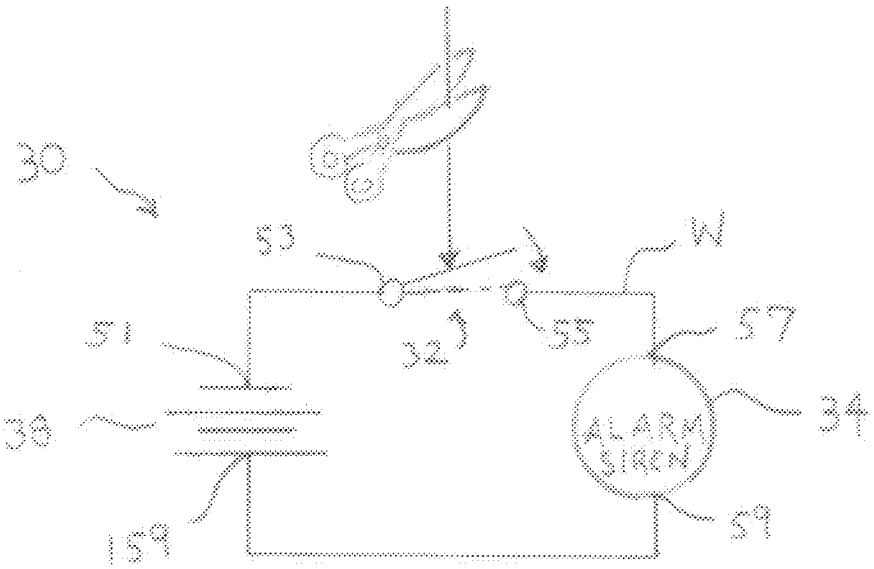
FIG. 8 is a schematic view of the electrical circuit used to power the alarm.

Padlock 10 features an integral alarm circuit 30, which is depicted schematically in FIG. 8. Individual components of the circuit are also shown in FIGS. 4, 5, 6 and 7. As is more fully described below, alarm circuit 30 is activated to indicate that shackle 14 has been cut. The alarm circuit includes a piezoelectric siren 34 that is accommodated within alarm housing 1. A 12-volt battery 38 energizes siren 34. Wiring W interconnects the battery to the siren. In particular, battery 38 is accommodated within a battery compartment 37 in lock body 12 and is supported therein by a helical spring 39 that urges the battery upwardly against a battery plug 41 within receptacle 26. As best shown in FIGS. 1, 2 and 4, receptacle 26 includes a pair of radial notches 43 that receive aligned radial tabs 45 of plug 41. The plug has a generally cylindrical shape and the center opening 47 of plug 41 is sized to accommodate the distal end 20 of shackle 14 when the shackle is retractably engaged with receptacle 26. After battery 38 is inserted into battery compartment 37, cylindrical plug 41 is inserted axially into receptacle 26 by aligning tabs 45 with lock body notches 43. A flathead screwdriver is engaged with aligned grooves 145 (FIG. 4) in plug 41 and turned to lock battery 38 and plug 41 within receptacle 26 and compartment 37 respectively. A lower metallic contact 49 of plug 41 electrically engages the positive terminal of battery 38. An electrically conductive battery connection 51, FIGS. 4 and 7 engages battery plug contact 49. Connection 51 is joined by wiring W to a terminal 53 of alarm switch 32. See FIG. 8. The alarm switch includes a second terminal 55 that is normally separated from terminal 53 such that the switch is open and the alarm is deactivated under normal conditions. Terminal 55 of switch 32 is, in turn, connected by wiring to a red terminal 57 of siren 34. A black terminal 59 of the siren is connected by wiring W to the negative terminal 159 of battery 34 (i.e. through support spring 39). Switch 32 preferably comprises a standard push button switch that is alternatable between open and closed conditions. As previously indicated, the switch includes a pair of normally open contacts or terminals 53 and 55. When the actuator button 61 of switch 32 is pushed, the contacts 53 and 55 are closed. Conversely, under normal conditions and in the absence of a force being applied to push button 61, the contacts remain separated and opened. During operation of the padlock alarm, the push button switch is activated to operate the circuit by actuator 64, FIGS. 4 and 7. This is accomplished in a manner that we described more fully below. It should be understood that various alternative alarm configurations, connections and components may be used within the scope of this invention. Operation of the alarm is described more fully below.

As best depicted in FIG. 7, shackle 14 includes a longitudinal interior channel or bore 60. A cut detecting sensor comprising an elongate cable 62 extends longitudinally through channel 60 of shackle 14. In particular, the shackle carries a switch actuator 64 comprising a generally tubular sleeve 66 that is slidably received by channel 60 at proximal end portion 16 of shackle 14. Sleeve 66 slides longitudinally within channel 60 and is biased outwardly from the proximal end of the shackle by an inner coil spring 68 that extends between proximal end 16 of shackle 14 and a distal flange 70 of sleeve 66. A first end of cable 62 is fastened within the central opening of sleeve 66 by a fastening plug 72, which is received by the lower end of sleeve 66. The cable is pinched between plug 72 and the interior wall of sleeve 66. The opposite end of cable 62 is similarly pinched between a fastening plug 72*a* and the inner wall of shackle channel 60. As a result, cut detecting cable 62 is secured within the channel. When the shackle is retractably engaged with the lock body and locked, as shown in FIGS. 6 and 7, cable 62 extends through the entire length of the shackle disposed outside the lock body. This enables the device to immediately detect when the shackle is cut at any point above or outside the lock body. It should be understood that, although cable is a preferred element comprising the cut detection sensor, alternative materials and various compositions may be employed to provide the cut detecting function of this invention.

As previously indicated, keyhole cylinder 3, FIG. 3, is axially rotatably mounted in a recess or cavity formed in the bottom 5 of lock body 12. As best shown in FIG. 9, cylinder 3 is a component of a cartridge 73 that is mounted in the lock body. The keyhole cylinder is received by and axially rotatable within a cylindrical shell or sleeve 75. An anti-rotation rib or block 77 is attached to and extends longitudinally along sleeve 75. The block is received in a conformably shaped pocket or recess 177 in the back half 15 of the lock body (see FIG. 5) to restrict rotation of sleeve 75 when keyhole cylinder 3 is turned. This provides for easy, interference free operation of the key and keyhole cylinder to open or close the lock as required. More particularly, cylinder 3 has a key slot 8, FIGS. 3, 7 and 9, which receives a corresponding key (not shown) for selectively turning cylinder 3 within sleeve 75 in either a clockwise (locking) or counterclockwise (unlocking) direction.

As shown in FIG. 9, the inner end of keyhole cylinder 3 carries a plurality of engagement teeth 79 that are arranged in a generally circular configuration extending from the inner end of the keyhole cylinder. Teeth 79 operatively interengage a plurality of complementary teeth 81 carried by a shackle retention assembly 11, shown slightly separated from cartridge 73 in FIG. 9. The keyhole cylinder cartridge 73 and shackle retention assembly 11 are also depicted in an operatively interengaged condition in FIG. 4 and are depicted as installed in lock body in FIGS. 5, 6 and 7. The individual components of shackle retention assembly 11 are also shown in the exploded condition illustrated in FIG. 10. Shackle retention assembly 11 secures the shackle in a closed and locked condition and prevents the locked shackle from being axially rotated and opened relative to lock body 12 in the event that the shackle is cut.

The shackle retention assembly comprises three actuator disks 82, 84 and 86 that are spaced apart and arranged generally parallel to one another. Disks 82 and 84 are sandwiched about a first retention member 88, which includes a forked plate having a pair of parallel fingers 90 and 92 separated by a gap 94. Plate 88 also includes a cam slot 96 that is operatively interengaged with a cam element 98 carried by disk 84. Actuator disks 84 and 86 are likewise sandwiched about a second retention member 100 comprising a forked retention plate analogous to the previously described plate. In particular, plate 100 includes a pair of parallel fingers 102 and 104 separated by a gap 106. A cam slot 108 in plate 100 is interengaged by a cam element 110 carried by the inside surface of disk 86. The actuator disks 82, 84 and 86 and interposed retention plates 88 and 100 are stacked in the manner best shown in FIGS. 6, 7 and 9. These components are secured and effectively locked together by an engaged bolt or screw 112, FIGS. 6, 7, and 10. Bolt 112 extends through aligned central holes 116 and 188 in disks 82 and 84, respectively, and through slots 120 and 122 in plates 88 and 100, respectively. The bolt is received by and fastened to internally threaded receptacle 124 carried centrally by disk 86. As best shown in FIG. 9, the outside facing surface of disk 86 carries teeth 81, which operatively interengage the complementary teeth 79 carried by keyhole cylinder 3.

When shackle 14 is retracted within lock body 16 and distal end 20 of the shackle is received by central opening 47 of battery plug 41, locking slot 24 is aligned with a corresponding locking slot 91 formed in plug 41. See FIGS. 5 and 6. Aligned slots 24 and 91, as well as locking slot 22 formed near the proximal end 16 of shackle 14, are positioned in the retracted condition such that they are alignable and engageable with forked plates 88 and 100 respectively of shackle retaining assembly 11. Each locking slot 22 and 24 may comprise a diametrically opposed pair of discrete, flat bottom notches formed transversely in the shackle. Plug locking slot 91 may likewise feature a generally parallel pair of discrete diametrically opposed notches formed in plug 43. More particularly, when the shackle is retracted into the lock body, the user may turn the key cylinder with a matching key so that the key cylinder rotates the actuator disks to engage plate 88 with aligned slots 90 and 24 and, by the same token, to engage plate 100 with locking slot 22. See FIGS. 5, 6, 7, 11 and 12. In this condition, the shackle retention assembly holds the shackle in a closed and locked condition. Alternatively, the shackle may be opened by engaging a matching key with keyhole 8 of key cylinder 3 and rotating the key cylinder in the opposite direction. This causes the actuator disks 82, 84 and 86 to rotate such that the plate 88 disengages slots 91 and 24 and plate 100 disengages slot 22. Spring 29 bearing against snap ring 27 urges the shackle upwardly such that the distal end 20 of the shackle releases from plug 41 and receptacle 26. The shackle is thereby opened as shown in FIG. 5A. Plates 88 and 100 of retention assembly 11 are pushed inwardly by rotation of the actuator disks and operative interengagement between the cam elements 98, 110 and interengaged cam slots 96, 108 respectively. In preferred embodiments, the shackle retention assembly is constructed so that it operates entirely internally within the lock body as shown.

Figure 11:
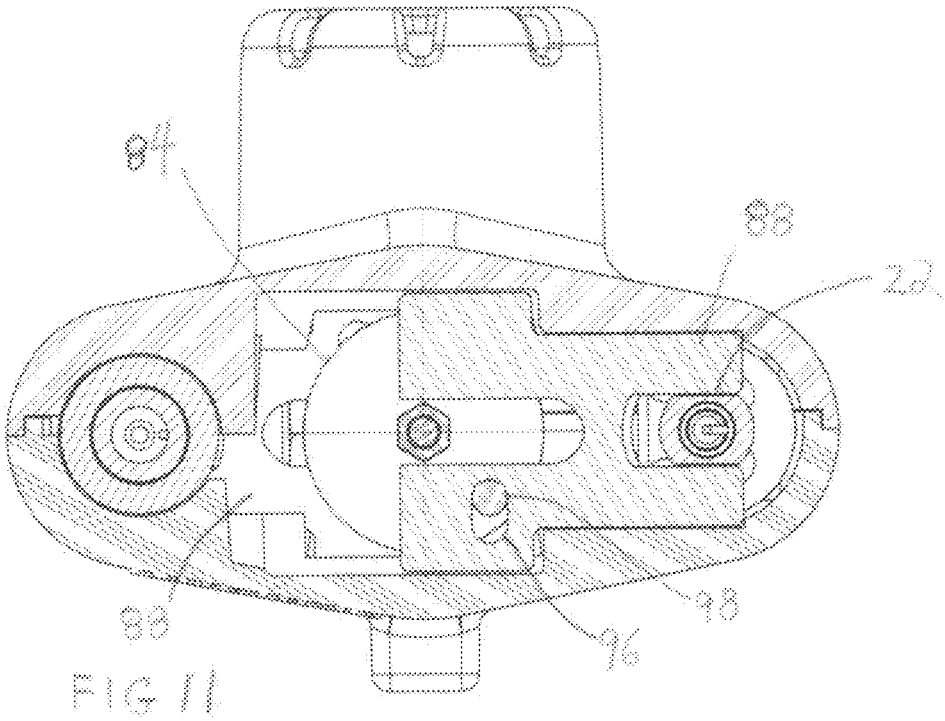
FIG. 11 is a cross sectional view of the upper retention plate engaged with an upper locking slot of the shackle, as taken along line 11-11 of FIG. 1.
Figure 12:
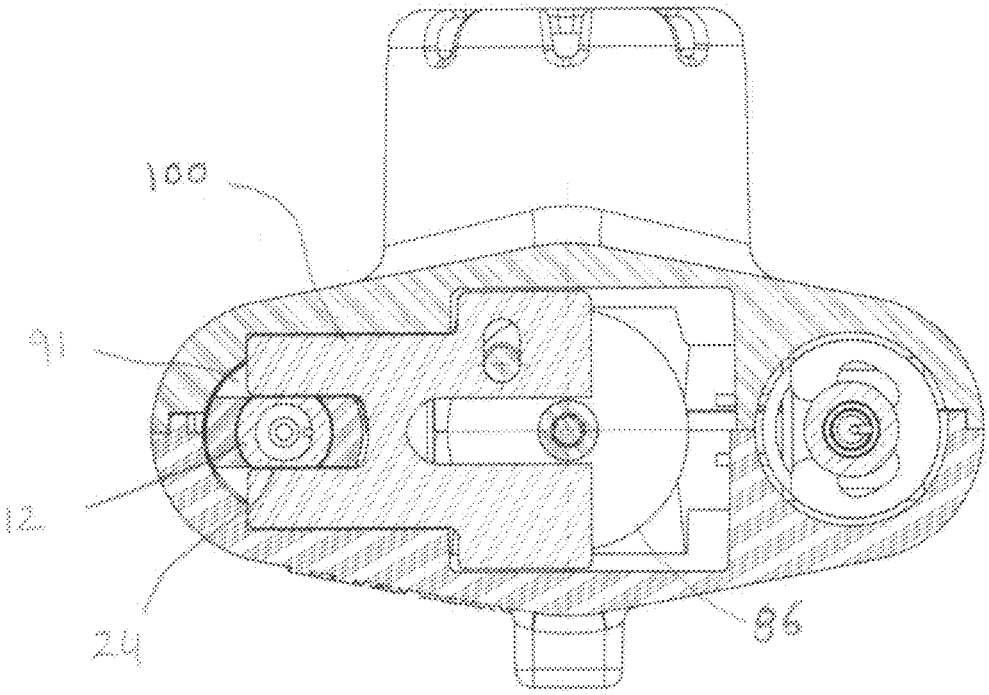
FIG. 12 is a cross sectional view of the lower retention plate engaged with the lower locking slot of the shackle, as taken along line 12-12 of FIG. 1.

In operation, to lock and arm padlock 10, the padlock is attached to a locker, lockbox or other item in a conventional manner such as by engaging shackle 14 with the item to be locked. This occurs when the shackle is in the open condition, as shown in FIG. 5A. In that condition, the forked plates 88 and 100 of retention assembly 11 are disengaged from the shackle and the distal end 20 of shackle 14 is removed from receptacle 26 and battery plug 41. The shackle is freely pivotable or rotatable relative to the lock body about the proximal end 16 of the shackle. After engaging shackle 14 with the item to be locked, the shackle is pivoted relative to body 12 so that the distal end 20 is aligned with receptacle 26 in lock body 12. To lock and arm padlock 10, shackle 14 is pushed downwardly such that proximal end 16 of the shackle slides downwardly within compartment 18 and distal end 20 is inserted into central opening 47 of battery plug 41. The shackle is then in the closed condition generally shown in FIGS. 1-3, 5-7, 11 and 12 with the retention assembly 11 in the position shown in FIGS. 6, 7, 11 and 12. The user engages a key matched to keyhole 8 with the lock and turns the key cylinder 3 such that the interengaged teeth 79 and 91 cause actuator disks 82, 84 and 86 to axially rotate in unison. The cam elements 98 and 110 carried respectively by disks 84 and 86 interengage respective cam slots 96 and 108 in plates 88 and 100 and thereby drive the forked retention plates 88 and 100 into an extended condition wherein the forked plates interengage the respective locking slots. More specifically, as best shown in FIGS. 11 and 12, the fingers 90 and 92 of plate 88 engage the diametrically opposed flat surfaces of shackle locking slot 22; and fingers 102 and 104 of plate 100 are received by the discrete notches of slot 91 of plug 47 and similarly engage the diametrically opposed flat surfaces of locking slot 24. As a result, shackle 14 is locked securely into padlock body 12 at both ends of the shackle. Moreover, if the shackle is cut, shackle 14 cannot be axially rotated due to the interference between the flat edges of fingers 90, 92, 102, 104 and the interengaged flat surfaces of the locking slots.

The foregoing operation also effectively arms the alarm circuit. In particular, referring to FIGS. 6-8, with the shackle locked in place, cable 62 retains sleeve 66 in a retracted condition within channel 60 of shackle 14. The tubular sleeve is effectively pulled upwardly against the resilient force of inner spring 68 and the lower end of sleeve 66 and plug 72 are vertically separated from push button 61 of switch 32. The normally open switch remains open and, as a result, the alarm remains deactivated so that the siren does not sound.

Subsequently, if a thief transversely cuts shackle 14, cable 62 will likewise be cut. As a result, the broken cable will release the spring loaded sleeve 66, which will extend longitudinally outwardly from channel 60 of shackle 14. The lower end of the actuator (i.e. the flanged end 70 of sleeve 66 and the enclosed plug 72) presses against push button 61, which retracts and closes the contacts 53 and 55, FIG. 8. Power is thereby provided through wiring W from battery 38 to siren 34. A piercing alarm sounds to deter the thief. It is much less likely that a thief will remain on the scene while the alarm continues to audibly alert others as to the problem. Accordingly, it is much less likely that the lock will be completely removed and valuable property stolen.

To disarm the alarm circuit and remove the lock, the user simply engages the key with key slot 8 and rotates the key cylinder in an opposite direction until the plates 88, 100 of the shackle retention assembly 11 disengage the locking slots 22, 24 in the shackle. This releases shackle 14 from lock body 12. The shackle is urged upwardly by spring 29 and effectively disarms the alarm, which can only operate when the shackle is locked and cut. When the shackle opens, actuator sleeve 66 is separated sufficiently from switch 32 such that it cannot engage the switch in the open condition, even if cord 62 is cut and the actuator is released. Because the alarm does not operate when the shackle is open, battery power is conserved. In the locked condition, the retention plates hold the shackle in a closed and locked condition as previously described. In addition, the forked plates and locking slots are configured with interengaging flat surfaces as described above such that when the retention plate interengages the locking slots, the shackle is prevented from rotating and opening when it is cut by a thief.

The lock may be re-used as needed by simply rotating the open shackle, re-engaging it with an item to be locked and closing the lock as previously described. The shackle is simply re-closed and the key cylinder is again operated by a matching key to re-engage the retention plates 88 and 100 with the respective locking slots of the retracted shackle. In this condition, the retention plates are returned to the closed position shown in FIGS. 5, 6, 11 and 12. It is particularly preferred that the shackle retention assembly be internally accommodated by the lock body at all times as described herein. The lock and its operational components are thus less apt to be adversely affected by rain, snow, dirt or other contaminants.

The alarm system may be tested quickly and conveniently or operated as a panic or emergency alarm when the padlock is in an unlocked and open condition. The user accomplishes this by simply pressing shackle 14 downwardly against springs 29 and 39. This causes flanged end 70 of actuator 64 to push against button 61, which closes switch 32. The switch is pushed against the lower end of sleeve 66, which depresses button 53 and closes switch 32. If the alarm sounds, this indicates that the siren and alarm circuit are in proper operating condition. If the alarm does not sound, this indicates that there is a malfunction in the alarm, which should be addressed and corrected. Likewise in the event of an emergency, pushing downwardly on the open shackle activates the loud, audible alarm.

It should be understood that the padlock alarm of this invention can also be used effectively in bicycle locks and other locks employing elongate or otherwise different hasp or shackle configurations.

In alternative versions of the invention, the front and back half pieces 13 and 15, shown in FIGS. 1-3, may feature respective slotted channels for accommodating passage of a retention plate assembly featuring a pair of retention plates that pivot exteriorly of the lock body 12 during the locking operation. Such slots are not disclosed in the preferred version described herein, where the retention plate assembly is incorporated entirely internally within the lock body. The retention member and corresponding locking slots may feature alternative configurations from those shown herein. Most critically, the retention assembly must feature plates or other members that interengage complementary locking slots in the shackle when the lock is closed such that the shackle is prevented from axially rotating relative to the lock body if the shackle is transversely cut.

To replace battery 38, shackle 12 is opened as described above. A flathead screwdriver or similar implement (not shown) engages aligned grooves 145 in plug 41 and is turned to align radial plug tabs 45 with slots 43. The battery spring 39 lifts battery 38 and plug 41 so that the plug and battery can be easily removed through receptacle 26.

The padlock of this invention therefore provides for an improved and effective alarm circuit that is nonetheless much simpler than that utilized by existing designs. Manufacturing is greatly facilitated and the padlock does not utilize complex or expensive wiring or circuitry. Operation is simple and extremely reliable. Manufacturing is facilitated and engineering and assembly costs are greatly reduced. When a single cut is formed in the alarm, the alarm continues to sound, which makes removal of the lock and theft of the locked items much less likely.

From the foregoing it may be seen that the apparatus of this invention provides for an audible alarm for indicating that the lockable arm of a padlock has been cut. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A theft resistant padlock comprising:

a lock body;

an elongate locking shackle having a first end portion that is received by an interior chamber of said lock body such that said first end portion is retractable and axially pivotable within said interior chamber; said locking shackle having an opposite second end portion that is alignable with and selectively received by a shackle receptacle in said lock body when said shackle is retracted to close said padlock;

said lock body accommodating an axially rotatable keyhole cylinder, which includes a keyhole for receiving a matching key and being turned by the matching key to axially rotate said keyhole cylinder within said lock body;

a shackle retention assembly attached to said keyhole cylinder and including an opposing pair of retention members that are lockingly engageable with corresponding locking slots formed proximate respective opposite ends of said shackle;

said shackle being retracted relative to said lock body and said second end of said shackle being received by said shackle receptacle whereby turning the matching key engaged with said keyhole in a first forward direction axially rotates said key cylinder and engages said retention members with said corresponding locking slots to hold said shackle in a closed and locked condition and turning the matching key engaged with said keyhole in an opposite reverse direction rotates said key cylinder to disengage said retention members from said corresponding locking slots and open said shackle relative to said lock body;

an alarm circuit including an alarm, a battery power source and a switch interconnecting said battery power source and said alarm for alternately activating and deactivating said alarm, said shackle carrying a cut detection sensor for sensing when said shackle has been cut;

a switch actuator responsive to said cut detection sensor for operating said switch to activate said alarm when said shackle is cut;

a shackle lifting spring within said lock body for urging said shackle into a lifted condition to open said shackle relative to said lock body when a matching key engaged with said keyhole is turned in the opposite reverse direction to disengage said retention members from said corresponding locking slots; and a switch actuator spring interconnecting said first end portion of said shackle and said switch actuator for urging said switch actuator to slide outwardly from said shackle channel such that when said shackle is cut, said cut detection sensor releases said switch actuator and said switch actuator spring urges said switch actuator to engage said switch and activate said alarm.

2. The device of claim 1 in which said lock body includes a battery compartment proximate and generally aligned with said shackle receptacle.

3. The device of claim 2 in which said shackle receptacle accommodates a removable plug that covers and retains said battery within said compartment.

4. The device of claim 3 in which said plug includes a central opening for receiving said second end portion of said shackle when said shackle is retracted.

5. The device of claim 4 in which said plug includes a retention member engagement slot that is alignable with said locking slot proximate said second end of said shackle for receiving a respective retention member to hold said shackle in the locked condition.

6. The device of claim 1 in which each said retention member includes a plate, each said plate including a pair of spaced apart and generally parallel fingers and further wherein each said locking slot includes a discrete pair of diametrically opposed, flat bottom notches formed transversely in said shackle, each said finger being engageable with a corresponding said flat bottom notch in said shackle.

7. The device of claim 1 in which each said retention member includes a plate and said retention assembly further includes a plurality of actuator disks for operatively interconnecting said keyhole cylinder and said plates, said actuator disks being responsive to rotation of said cylinder in a first direction for extending said plates to engage said corresponding locking slots and in a second direction for retracting said plates to disengage said corresponding locking slots.

8. The device of claim 7 in which said shackle retention assembly is enclosed entirely within said lock body when said lock retention plates are engaged with and disengaged from said corresponding locking slots.

9. The device of claim 1 in which said cut detection sensor includes an elongate cable extending through an interior channel of said shackle.

10. The device of claim 9 in which said cable is interconnected between said switch actuator and said second end portion of said shackle.

11. The device of claim 10 in which said switch actuator includes a sleeve that is longitudinally slidable through said channel and extends beyond said first end of said shackle.

12. The device of claim 1 in which said shackle is further retractable into said lock body when said retraction members are disengaged from said corresponding locking slots for compressing said lifting spring and engaging said switch actuator with said alarm switch whereby said alarm is activated.

13. The device of claim 1 in which said shackle retention assembly includes a pair of retention plates interconnected by a linkage assembly to said keyhole cylinder, said linkage including a parallel pair of rotatable actuator disks, each carrying a cam element that operatively engages a cam slot in a corresponding said retention plate, whereby axially rotating said keyhole cylinder in said forward direction turns said actuator disks to drive said retention plates to engage said corresponding locking slots in said shackle and axially rotating said keyhole cylinder in said reverse direction turns said actuator disk to drive said retention plates to disengage said corresponding locking holes in said shackle.

14. The device of claim 1 in which said keyhole cylinder is axially rotatably within a cylinder cartridge that carries anti-rotation block for mounting in said lock body and restricting rotation of said cartridge therein.

15. A theft resistant padlock comprising:

a lock body;

an elongate locking shackle having a first end portion that is received by an interior chamber of said lock body such that said first end portion is retractable and axially pivotable within said interior chamber; said locking shackle having an opposite second end portion that is alignable with and selectively received by a shackle receptacle in said lock body when said shackle is retracted to close said padlock;

an alarm circuit including an alarm, a battery power source and a switch interconnecting said battery power source and said alarm for alternately activating and deactivating said alarm, said shackle carrying a cut detection sensor for sensing when said shackle has been cut; and a switch actuator responsive to said cut detection sensor for operating said switch to activate said alarm when said shackle is cut; said cut detection sensor including an elongate cable extending through an interior channel of said shackle, said cable being interconnected between said switch actuator and said second end portion of said shackle; said switch actuator including a sleeve that is longitudinally slidable through said channel and extends beyond said first end of said shackle, said device further including a switch actuator spring interconnecting said first end portion of said shackle and said switch actuator for urging said switch actuator to slide outwardly from said shackle channel such that when said shackle is cut, said cut detection sensor releases said switch actuator and said switch actuator spring urges said switch actuator to engage said switch and activate said alarm.

16. A theft resistant padlock comprising:

a lock body;

an elongate locking shackle having a first end portion that is received by an interior chamber of said lock body such that said first end portion is retractable and axially pivotable within said interior chamber; said locking shackle having an opposite second end portion that is alignable with and selectively received by a shackle receptacle in said lock body when said shackle is retracted to close said padlock;

an electrically energizable alarm circuit including an alarm, a battery power source and a switch interconnecting said battery power source and said alarm for alternately activating and deactivating said alarm, said shackle carrying an elongate cut detection sensor which extends through an interior channel of said shackle for sensing when said shackle has been cut which cut detection sensor is disconnected electrically from said alarm circuit and not electrically energized by said battery;

a switch actuator responsive to said cut detection sensor for operating said switch to activate said alarm when said shackle is cut;

said switch actuator being slidable longitudinally through said channel and extendable beyond said first end portion of said shackle; said cut detection sensor constraining said switch actuator from engaging said switch to maintain said switch in a state wherein said alarm is deactivated; and a switch actuator spring for urging said switch actuator to extend outwardly from said shackle channel when said shackle and said cut detection sensor are cut, such that said cut detection sensor releases said switch actuator and said switch actuator engages said switch to activate said alarm.

17. The device of claim 16 in which said cut detection sensor includes an elongate cable extending through an interior channel of said shackle, said cable being interconnected between said switch actuator and said second end portion of said shackle.

18. The device of claim 17 in which said switch actuator includes a sleeve that is longitudinally slidable through said channel and extends beyond said first end of said shackle, said device further including switch actuator spring interconnecting said first end portion of said shackle and said switch actuator for urging said switch actuator to slide outwardly from said shackle channel such that when said shackle is cut, said cut detection sensor releases said switch actuator and said switch actuator spring urges said switch actuator to engage said switch and activate said alarm.

19. The device of claim 16 in which said cut detection sensor is responsive to said shackle being cut for releasing said actuator such that said actuator operates said switch to activate said alarm only when said shackle is retracted and said padlock is closed.

20. The device of claim 16 in which said cut detection sensor includes a cable interconnected between said actuator and said second end portion of said shackle.

* * * * *